United States Patent [19]

Peter et al.

[11] Patent Number: 4,756,818

[45] Date of Patent: Jul. 12, 1988

[54] A METHOD FOR THE PRODUCTION OF A CARBON FIBER PRECURSOR

[75] Inventors: Siegfried Peter, Uttenreuth-Weher; Herbert Beneke, Castrop-Rauxel; Franz Oeste, Münzenberg; Wolfgang Fexer, Erlangen; Wolfgang Jaumann, Nuremberg; Manfred Meinbreckse, Friedrichsdorf; Joachim Kempfert, Kronberg, all of Fed. Rep. of Germany

[73] Assignee: Rutgerswerke Aktiengesellschaft, Fed. Rep. of Germany

[21] Appl. No.: 18,200

[22] Filed: Feb. 24, 1987

[30] Foreign Application Priority Data

Mar. 27, 1986 [DE] Fed. Rep. of Germany ..... 3610375

[51] Int. Cl.[4] ..... C10C 1/18

[52] U.S. Cl. ..... 208/45; 208/433; 423/447.4

[58] Field of Search ..... 208/45, 433

[56] References Cited

U.S. PATENT DOCUMENTS

| | | | |
|---|---|---|---|
| Re. 32,120 | 4/1986 | Low | 208/433 |
| 2,572,583 | 10/1951 | Antle | 208/45 |
| 3,087,887 | 4/1963 | Corbett et al. | 208/45 |
| 3,202,605 | 8/1965 | Redcay | 208/45 |
| 4,036,731 | 7/1977 | Martin | 208/433 |
| 4,101,416 | 7/1978 | Dolbear | 208/45 |
| 4,127,472 | 11/1978 | Migitaka et al. | 208/45 |
| 4,184,942 | 1/1980 | Angier et al. | 208/45 |
| 4,208,267 | 6/1980 | Diefendorf et al. | 208/45 |
| 4,219,404 | 8/1980 | Dickakian | 208/22 |
| 4,259,171 | 3/1981 | Stedelhofer | 208/45 |
| 4,390,411 | 6/1983 | Scinta et al. | 208/433 |
| 4,402,824 | 9/1983 | Sunami et al. | 208/45 |
| 4,482,453 | 11/1984 | Coombs et al. | 208/45 |
| 4,502,943 | 3/1985 | Dickakian et al. | 208/45 |
| 4,503,026 | 3/1985 | Dickakian et al. | 423/447.4 |
| 4,517,072 | 5/1985 | Cukier et al. | 208/45 |
| 4,559,133 | 12/1985 | Siegfried et al. | 208/424 |
| 4,575,412 | 3/1986 | Yudate et al. | 208/45 |
| 4,578,177 | 3/1986 | Yundate et al. | 208/45 |
| 4,582,591 | 4/1986 | Hoermeyer et al. | 208/45 |
| 4,604,184 | 8/1986 | Cukier et al. | 208/45 |
| 4,620,919 | 11/1986 | Uemura et al. | 208/45 |
| 4,637,906 | 1/1987 | Fukuda et al. | 208/45 |
| 4,640,761 | 2/1987 | Mori et al. | 208/45 |

*Primary Examiner*—Carl F. Dees
*Assistant Examiner*—Helane Myers
*Attorney, Agent, or Firm*—Bierman and Muserlian

[57] ABSTRACT

A method for the production of a carbon fiber precursor from coal tar pitch comprising extracting coal tar pitch at elevated temperatures and pressures with a mixture of a supercritical gas and an entraining agent to obtain a solution free of quinoline-insoluble components, recovering from the solution by lowering the pressure and/or raising the temperature to obtain at least one fraction selected from the group consisting of quinoline-soluble fraction and toluene-soluble fraction, treating the said fraction(s) at 380° to 450° C. under a non-oxidizing atmosphere at atmosphere pressure until 40 to 65% by volume of the product is converted into pitch containing mesophase, extracting the latter pitch with a mixture of supercritical gas and an entraining agent to remove isotropic pitch and recovering isotropic pitch with a mesophase content of at least 75% by volume, a pyridine-insoluble matter content of 20 to 50% by weight, a mean molecular weight of 900 to 1200 and a melting point of 330° to 360° C. and the isotropic pitch product produced therefrom and carbon fibers made from the isotropic pitch.

9 Claims, No Drawings

A METHOD FOR THE PRODUCTION OF A CARBON FIBER PRECURSOR

STATE OF THE ART

Most known carbon fibers are produced by carbonizing and graphitizing fibers from polyacrylic nitrile and these carbon fibers have high strength and a high modulus of elasticity. A disadvantage is, however, that the starting product is expensive and the carbonization yield is low. Many attempts have been made to test other usable products of high coking residue for their suitability for the manufacture of carbon fibers and there have been proposed mainly coal- and mineral oil-derived pitches which are known for the production of highly anisotropic coke.

The spinning temperatures are about 60° to 130° C. above the softening point of the pitch used. At high spinning temperatures, decomposition of the pitch already occurs with the pitch being transformed at least partially into the semicoke stage, and considerable quantities of gas are formed which interferes with the spinning process. Frequent filament ruptures result which make continuous spinning impossible To avoid this, pitches of as low as possible a softening point are necessary and such have a low content of components insoluble in quinoline or pyridine. Their main molecular weight is relatively low with a wide molecular weight distribution and this complicates the process step of making the pitch fiber infusible before the carbonization.

In DE-OS No. 35 09 861, a method is described for the production of suitable carbon fiber precursors from aromatic, mineral oil-derived residue oils. The light oils are removed by distillation and the residue is subjected to a two-stage heat treatment under pressure 0.13 to 65 mbar in a falling film vaporizer. The temperatures, particularly in the second treatment stage, are as high at 450° to 500° C. so that partial formation of coke structures cannot be prevented. This is true particularly when using thin-layer vaporizers with rotating inserts which are wetted by the pitches, so that the residence time of a portion of the pitch charged becomes uncontrollable. Because of the different reactivity of the pitches and the necessity to remove the pitch components not transferred into anisotropic pitch from the carbon filber precursor, the known processes are very costly and often can be carried out only under laboratory conditions.

OBJECTS OF THE INVENTION

It is an object of the invention to produce a pitch material for carbon fiber production which has excellent spinnability, which can be made infusible in a short time, and from which carbon fibers of high strength combined with a high modulus of elasticity can be produced, while the above disadvantages and problems in the production of the pitch material do not occur.

It is another object of the invention to provide novel anisotropic pitch and carbon fibers produced therefrom.

These and other objects and advantages of the invention will become obvious from the following detailed description.

THE INVENTION

The novel method of the invention for the production of carbon fiber procursor from coal tar pitch comprising extracting coal tar pitch at elevated temperatures and processes with a mixture of a supercritical gas and an entraining agent to obtain a solution free of quinoline-insoluble components, recovering from the solution by lowering the pressure and/or raising the temperature at least one fraction selected from the group consisting of quinoline-soluble fraction and toluene-soluble fraction, treating the said fraction(s) at 380° to 450° C. under non-oxidizing atmosphere at atmospheric pressure until 40 to 65% by volume of the product is converted into pitch containing mesophase, extracting the latter pitch with a mixture of a supercritical gas and an entraining agent to remove isotropic pitch and recovering anisotropic pitch with a mesophase content of at least 75% by volume, a pyridine-insoluble matter content of 20 to 50% by weight, a mean molecular weight of 900 to 1200 and a melting point of 330° to 360° C.

Examples of the supercritical gas extracting agent are aliphatic or olefinic hydrocarbons, preferably of 2 to 5 carbon atoms, and halogenated hydrocarbons of 1 to 4 carbon atoms and mixtures thereof above their critical temperature and critical pressure.

Examples of suitable entrainers are mono- and polynuclear aromatic hydrocarbons optionally substituted with alkyl groups, especially with up to 2 carbon atoms, or with an amino and which can be not only aromatic but also totally or partially hydrogenated. It is also possible to use mono- or binuclear heterocyclic compounds, especially heterocyclic compounds containing nitrogen, in which one nucleus or both nuclei are heterocyclic and alkyl esters of aromatic carboxylic acids with preferably 1 to 6 carbon atoms in the alcohol. Suitable entrainers are for instance crude benzene, commercial benzene, platformate cuts with a boiling range between 70° and 200° C., preferably between 100° and 150° C., methylnaphthalene and methylnaphthalene fractions as well as mixtures thereof.

The extraction step is preferably carried out under temperature and pressure conditions which lie above the critical pressure and the critical temperature of the supercritical gas, but below the critical temperature of the entrainer. Generally, these pressures are between 80 and 300 bars and the temperatures are in the range from 80° to 300° C. Preferably, the pitch is extracted under a pressure from 150 to 250 bars at a temperature from 120° to 250° C. In so doing, a single-phase mixture of pitch, entrainer and supercritical gas is produced and the undissolved solids sediment can be separated out.

The obtained carbon fiber precursor is spun with a double-shaft screw extruder with a spinneret whose hole diameter is 0.2 to 0.4 mm at a temperature of 10 to 50 K. above the melting point at a drawing speed between 500 and 1200 m/min, preferably 800 to 1000 m/min. The pitch fibers are heated in an oxygen-containing gas such as air at a heating rate of 15 to 30 K/min from 250° to 350° C., and the end temperature is held for at least 3 minutes. The pitch fibers thus made infusible are carbonized in an inert gas stream for 10 to 20 minutes at 1300° to 1700° C. and thereafter optionally graphitized at 2000° to 2500° C.

The temperatures for the thermal treatment are high enough to ensure a sufficient reaction rate, but are so low that no bulk masophase tending to solidify forms. The subsequent extraction stage for the separation of a predominant part of the isotropic pitch material also takes place at such low temperatures at which the pitch mesophase does not change. Since the mesophases consist only of spherules readily undergoing plastic deformation which coalesce only as a result of the sheet forces in the extruder, the difference between melting temperature and spinning temperature can be reduced to 10 to 50 K without having to reduce the drawing speed.

In the following examples there are described several preferred embodiments to illustrate the invention. However, it is to be understood that the invention is not intended to be limited to the specific embodiments.

EXAMPLE 1

100 parts by weight of standard pitch having a content of ash formers of 0.23% by weight, a content of quinoline-insoluble matter (QI) of 5.8% by weight, a content of toluene-insoluble matter (TI) of 22.8% by weight, and a softening point (SP) of 70° C. according to Kramer-Sarnow (K-S) were placed in an autoclave with a stirrer heated to 150° C. Then, at a pressure of 180 bar, a mixture of 30% by weight of propane and 80% by weight of toluene as extraction and entraining agents was passed through the autoclave with stirring. The extraction mixture supercritical under these conditions, dissolved pitch up to a concentration of 13% by weight and transported it out of the autoclave. The pitch-laden solution was transferred into two successive regenerating autoclaves and expanded intermittently to a pressure of 50 bars. The temperature during regeneration was 150° C. The cooling which occurs during the expansion because of the Joule-Thomson effect was compensated by addition of heat and the regenerated mixture of supercritical gas and entraining agent was recycled. After an extraction time of 5 hours, the following pitch fractions were obtained in the regeneration autoclave:

| Fraction No. | Pressure bar | Yield wt. % | Ash wt. % | $QI_{af}$(*) wt. % | TI-QI wt. % | TS wt. % |
|---|---|---|---|---|---|---|
| 1 | 180 | 13 | 1.8 | 44.0 | 53.7 | 2.3 |
| 2 | 100 | 67 | 0 | traces | 23.6 | 76.3 |
| 3 | 50 | 20 | 0 | traces | 0.1 | 99.9 |

(*)$QI_{af}$ = Quinoline insoluble ash-free

Fraction 2 was treated thermally at 400° C. under nitrogen at atmospheric pressure for 1.5 hours with stirring to obtain 50% by volume of mesophase spherules. The mesophase pitch was extracted after cooling to 150° C. at a pressure of 130 bars with a mixture of 30% by weight of propane and 70% by weight of toluene. The residue was a pitch having a mesophase content of 80% by volume, a content of pyridine-insoluble matter (PI) of 32% by weight, a melting point of 342° C. and a mean molecular weight of about 1000. This pitch was spun at 370° C. through an extruder with a spinneret having a hole diameter of 0.3 mm at a drawing speed of 1000 m/min. The pitch fiber was heated in air at a heating rate of 20 K/min from 250° to 350° C. and the final temperature was maintained for 5 minutes to make the fiber infusible. Thereafter, the fiber was carbonized for 15 minutes at 1500° C. in an inert gas stream and the carbon fiber with a diameter of 9/μm had a strength of 2.47 kN/mm$^2$, a modulus of elasticity of 158 KN/mm$^2$ and a rupture elongated of 1.2%.

EXAMPLE 2

100 parts by weight of standard pitch [SP (K-S)=72° C., ash formers=0.23% by weight, QI=5.8% by weight, TI=22.7% by weight] were placed in an autoclave with a stirrer and the autoclave was heated to a temperature of 190° C. At a pressure of 200 bars, a mixture of 50% by weight benzene and 50% by weight of liquefied gas (LPG) as extraction and entraining agent was passed through the autoclave with stirring. During the extraction period of about 70 minutes, the main load of the solution was about 15% by weight and the pitch-laden solution was transferred into two successive regenerating autoclave and expanded intermittently to a pressure of 50 bars. The temperature in the regenerating autoclave was maintained at 190° C. and the regenerated mixture of benzene and LPG was returned into the stirred autoclave. The following pitch fractions were obtained.

| Fraction No. | Pressure bar | Yield % by wt | Ash % by wt | $QI_{af}$(*) % by wt | TI-QI % by wt | TS % by wt |
|---|---|---|---|---|---|---|
| 1 | 200 | 6.0 | 3.7 | 85.0 | 8.5 | 2.8 |
| 2 | 130 | 39.6 | 0 | 1.7 | 56.2 | 42.1 |
| 3 | 50 | 54.4 | 0 | 0 | traces | 99.9 |

Fraction 3 was treated thermally at 430° C. under nitrogen at atmospheric pressure for one hour with stirring to obtain 60% by volume of mesophase spherules. After cooling to 190° C., the mesophere pitch was extracted at a pressure of 130 bars with the same mixture as in the first extraction stage. The residue was a pitch with a mesophase content of 87% by volume containing 44% by weight of pyridine-insoluble matter with a melting point of 357° C. and a mass molecular weight of about 1100. The pitch was spun at 380° C., made infusible and carbonized as described in Example 1 and the carbon fiber of a diameter of 7 μm had a strength of 2.58 kN/mm$^2$, a modulus of elasticity of 153 kN/mm$^2$ and a rupture elongation of 1.0%.

Various modifications of the products and methods of the invention may be made without departing from the spirit or scope thereof and it is to be understood that the invention is intended to be limited only as defined in the appended claims.

What we claim is:

1. A method for the production of a carbon fiber precursor from coal tar pitch comprising extracting coal tar pitch at elevated temperatures and pressure with a mixture of a supercritical gas and an entraining agent to obtain a solution free of quinoline-insoluble components, recovering from the solution by lowering the pressure and/or raising the temperature at least one fraction selected from the group consisting of quinoline-soluble fraction and toluene-soluble fraction, heat-treating the said fraction(s) or a mixture of said fractions at 380° to 450° C. under non-oxidizing atmosphere at atmospheric pressure until 40 to 65% by volume of the product is converted into pitch containing mesophase, extracting the latter pitch with a mixture of a supercritical gas and an entraining agent to remove isotropic pitch and recovering anisotropic pitch with a mesophase content of at least 75% by volume, a pyridine-insoluble matter content of 20 to 50% by weight a mean molecular weight of 900 to 1200 and a melting point of 330° to 360° C.

2. The method of claim 1 wherein the supercritical gas is at least one member of the group consisting of aliphatic hydrocarbons of 2 to 5 carbon atoms, olefinic hydrocarbons of 2 to 5 carbon atoms and halogenated hydrocarbons of 1 to 4 carbon atoms.

3. The method of claim 1 wherein the supercritical gas is a liquiefied petroleum gas.

4. The method of claim 1 wherein the entrainer is at least one member of the group consisting of mono- and polynuclear aromatic hydrocarbons optionally substituted with alkyls of 1 to 2 carbon atoms or —$NH_2$ and optionally partially or totally hydrogenated, mono- and binuclear nitrogen heterocycles in which one or both nuclei are heterocyclic and aromatic carboxylic acid esters with alkanols of 1 to 6 carbon atoms.

5. The method of claim 1 wherein the entrainer is benzene.

6. The method of claim 1 wherein the extraction of the coal tar pitch is effected at 80° to 300° C.

7. The method of claim 1 wherein the extraction of the coal tar pitch is effect at 120° to 250° C.

8. The method of claim 1 wherein the extraction of coal tar pitch is effected at a pressure of 80 to 300 bars.

9. The method of claim 1 wherein the extraction of coal tar pitch is effected at 150 to 250 bars.

* * * * *